US009089762B1

(12) United States Patent
Magula et al.

(10) Patent No.: US 9,089,762 B1
(45) Date of Patent: Jul. 28, 2015

(54) GOLF GLOVE

(71) Applicants: Mark Magula, Renton, WA (US); Spencer Magula, Renton, WA (US)

(72) Inventors: Mark Magula, Renton, WA (US); Spencer Magula, Renton, WA (US)

( * ) Notice: Subject to any disclaimer, the term of this patent is extended or adjusted under 35 U.S.C. 154(b) by 0 days.

(21) Appl. No.: 14/619,331

(22) Filed: Feb. 11, 2015

Related U.S. Application Data

(60) Provisional application No. 62/076,317, filed on Nov. 6, 2014.

(51) Int. Cl.
*A63B 71/14* (2006.01)

(52) U.S. Cl.
CPC ..... *A63B 71/146* (2013.01); *A63B 2209/10* (2013.01); *A63B 2243/0029* (2013.01)

(58) Field of Classification Search
CPC ... A41D 19/00; A41D 19/0044; A41D 20/00; A41D 13/08; A63B 71/146; A63B 71/148; A61B 19/04
USPC ..... 2/159, 161.1, 161.2, 161.3, 161.4, 2/161.5, 162, 163, 167, 170, 910
See application file for complete search history.

(56) References Cited

U.S. PATENT DOCUMENTS

| | | | | | |
|---|---|---|---|---|---|
| 3,348,238 | A | * | 10/1967 | Hydock | 2/161.2 |
| 3,559,212 | A | * | 2/1971 | Skovron | 2/161.4 |
| 5,033,120 | A | | 7/1991 | Myers | |
| 5,088,122 | A | | 2/1992 | O'Toole | |
| 5,414,868 | A | * | 5/1995 | Crawford | 2/160 |
| 5,845,374 | A | | 12/1998 | Briggs | |
| 5,855,022 | A | | 1/1999 | Storto | |
| 6,073,269 | A | | 6/2000 | Diaco | |
| D460,585 | S | * | 7/2002 | Johnson | D29/116.2 |
| 7,051,377 | B1 | | 5/2006 | Milner et al. | |
| 7,058,984 | B2 | | 6/2006 | Newman | |
| 7,337,474 | B1 | * | 3/2008 | Godson et al. | 2/161.2 |
| 8,281,416 | B1 | * | 10/2012 | Smith | 2/161.6 |

* cited by examiner

*Primary Examiner* — Tejash Patel
(74) *Attorney, Agent, or Firm* — Mohr Intellectual Property Law Solutions, PC

(57) ABSTRACT

Golf gloves that support a golf club with the leading hand of the golfer. The glove appears to be a conventional golf glove, but contains a number of features configured to help improve one's golf game. The golf glove includes a golf club retainer, finger tension guide, and grip positioner. The golf club retainer includes a strap and a strap receiver. The strap is connected to a hinge that is located the top of the palm portion of the glove. The strap couples to the strap receiver for retaining a golf club and is largely concealed from view.

20 Claims, 4 Drawing Sheets

GOLF GLOVE

CROSS REFERENCE TO RELATED APPLICATIONS

This application claims priority to copending U.S. Provisional Application, Ser. No. 62/076,317, filed on Nov. 6, 2014, which is hereby incorporated by reference for all purposes.

BACKGROUND

The present disclosure relates generally to gloves used for golfing. In particular, gloves adapted to reduce the tension of a user's grip on a golf club are described.

Golfing is a multi-million dollar industry. Many see golf as a luxury sport where appearances are often very important. For those entering the sport, tools that serve to improve their overall golf game would be extremely desirable. There are currently golf gloves on the market that claim to help golfers improve their grip, but many fall short.

Known golf gloves are not entirely satisfactory because they fail to help golfers grip a club properly. Gripping a golf club with reduced tension is recognized as a way to improve one's golf swing and thereby improve one's golf game for the purpose of allowing the golfer to have a tension-free grip of a golf club. For example, existing golf game improvement gloves that provide golfer with gripping guidance wrap around the golfer's entire hand and places excessive pressure on the wearer's hand.

Furthermore, other short-comings of current golf gloves on the market that claim to improve the wearer's golf game include visibility and durability. For instance, current golf gloves for improving one's golf game are often extremely obvious. These golf gloves often include straps that that look like bandages that wrap around the golfer's hand. These bandaging straps are highly visible and embarrassing to use, especially on the golf course.

In addition, these bandage-type mechanisms on a golf glove are clumsy to adjust during an actual game making it even more apparent that the wearer is using a training tool. Furthermore, golf game improving gloves using a bandage type mechanism can easily become stretched out and misshaped over a short period of time.

The combination of these current golf gloves being highly visible and difficult to use often ultimately deters the wearer from continuing to use them. Even when a wearer sticks with using these bandage cover type systems, the bandage covers become ineffective over a short period of time because conventional bandage-type straps are not sufficiently durable.

Thus, there exists a need for golf game improvement gloves that improve upon and advance the design of known golf gloves. Examples of new and useful golf gloves relevant to the needs existing in the field are discussed below.

Examples of references relevant to golf gloves that aid to improve golf swing include: U.S. Pat. No. 5,845,374; U.S. Pat. No. 5,033,120; U.S. Pat. No. 5,088,122; U.S. Pat. No. 5,855,022; U.S. Pat. No. 7,058,984; U.S. Pat. No. 6,073,269; U.S. Pat. No. 5,845,374; U.S. Pat. No. 5,033,120; and U.S. Pat. No. 7,051,377. The complete disclosures of the above patent filings are herein incorporated by reference for all purposes.

U.S. Pat. No. 5,845,374 to Briggs discloses a seventeen inch strap, which is wrapped 360 degrees around the entire hand and club unit. The strap is fastened back to the top with a hook and loop fastener. As designed, the strapping device resembles a mummy wrapping, which makes the device impractical to use on a golf course and questionable for use anywhere but the golfer's own backyard. Additionally, the design actually puts unnatural pressure on the hand and the golf club making it near impossible to keep the user's wrists natural, relaxed, and soft, and thus adversely affects the required flexing of the wrists during the golf swing.

U.S. Pat. No. 5,033,120 to Myers discloses a golf glove that utilizes a hook and loop strap placed around the outside of the last two fingers of the left hand. The strap is holding the golf club adapted to better secure the fingers on the golf club to enhance the golf grip. This design falls short on the design end as it presents yet another "band aid" solution. The Myers strap looks like a bandaid wrapped around the fingers of the golfer's glove hand making it highly impractical as well as embarrassing for use on the golf course.

Additionally, though there would be some benefit to securing the golf grip at the top of the swing, the aforementioned patent falls short in providing a technology that secures the golf club handle without additional pressure and possibly tension in the golfer's hands. It would be desirable to create a secure grip without requiring additional pressure from the hands, creating a tension-free swing and improved ball striking.

U.S. Pat. No. 5,088,122 to O'Toole discloses a golf swing training glove for teaching proper grip on the golf handle. The O'Toole golf glove is similar to that from U.S. Pat. No. 5,845,374 where the strap is fastened over and around the hand, leaving the golfer with "mummy hands." The mummified hand is impractical for use on the golf course. This design would also be most likely relegated to backyard usage as a "training apparatus" despite the gripping benefits that the design provides.

SUMMARY

The present disclosure is directed to golf gloves that support a golf club with the leading hand of the golfer. The glove appears to be a conventional golf glove, but contains a number of features configured to help improve one's golf game. The golf glove includes a golf club retainer, finger tension guide, and grip positioner. The golf club retainer includes a strap and a strap receiver. The strap is connected to a hinge that is located at the top of the palm portion of the glove. The strap couples to the strap receiver for retaining a golf club and is largely concealed from view. Thus a golfer seeking to improve his golf game can wear the glove for improving his game on the golf course without overtly displaying the golf improving device.

DETAILED DESCRIPTION

Figure 1:
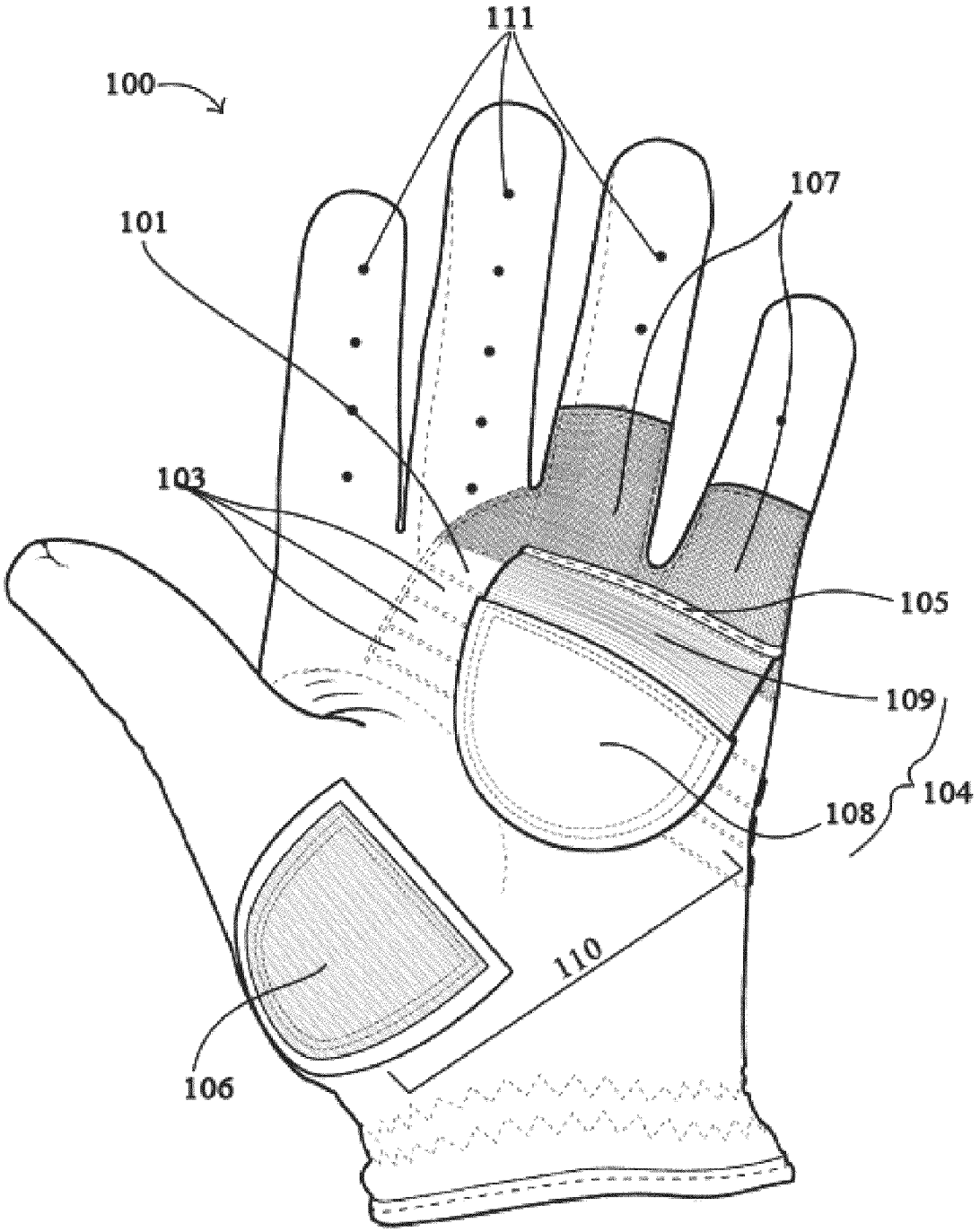
FIG. 1 is an open palm view of a golf glove including a finger tension guide, a grip positioning guide, a fastening strap, a hinge, and a strap receiver.

The disclosed golf glove will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of variations on the golf glove are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Overview of Glove

The golf gloves described herein is designed as a traditional golf glove. The golf glove includes a palm portion and a back portion that is coupled to the palm portion. The golf glove further includes fingers that are coupled to the palm and back portion, including an index finger portion able to receive the wearer's index finger, a middle finger portion able to receive the wearer's index finger, a ring finger portion able to receive the wearer's ring finger a pinky finger portion able to receive the wearer's pinky finger, and a thumb portion able to receive the wearer's thumb.

The golf gloves possess a revolutionary gripping mechanism that creates a correct and secure grip on a golf club while keeping the hands soft for a tension-free golf swing. Due to the unique design and the technology incorporated in the present glove, the glove is designed to be worn while on the golf course to improve ball striking in every aspect of the game including driving the ball, fairway play, short game chipping and putting.

One benefit of the golf glove is its ability to function and "grip" the club so the wearer does not need to apply pressure with the leading hand. The gloves described herein are engineered to create the required torque necessary to securely hold the golf club handle in place during the swing. To provide the necessary torque to the golf club, stretch and hold characteristics were engineered into the design of the golf glove with the applied use of elastic for desired stretch characteristics and a hook-loop fastening mechanism to create the required resistance and hold.

In addition, one of the major benefits of the golf gloves described herein is that they are designed to replicate a conventional golf glove. The disclosed golf gloves fit and look like a normal leather golf glove such that no one on the golf course or even in the wearer's foursome would know the wearer was wearing anything other than a standard leather glove unless the wearer told or showed them why his golf game had improved.

Finally, unlike the aforementioned patents, the present invention is designed, in some embodiments, to look exactly like a conventional golf glove. This allows the glove wearer to improve his game discretely without detection. The present invention is much more than a grip training device like the majority of patented golf grip devices, but instead is a golf game improvement glove designed for use by any golfer on virtually any course in the world.

With reference to FIGS. 1-4, a first example of a golf game improvement glove, golf glove 100, will now be described. Golf glove 100 includes a grip positioning insert 101, a grip positioning guide 103, a club retainer 110, a finger tension guide 107, and an elastic tensioner 109.

Club Retainer

As shown in the Figures, golf club retainer 110 is disposed on the palm portion of golf glove 100. In use, golf club retainer 110 is able to retain a golf club within golf glove 100. Club retainer 110 further includes a hinge 105, a strap 104 and a strap receiver 106 designed to securely hold the golf club in a golfer's hand without additional tension.

Hinge

Hinge 105 of golf club retainer 110 is attached to the body of golf glove 100 at the interface of finger tension guide 107 with grip positioning insert 101. Hinge 105 is located at the base of the ring and pinky finger where they meet the palm region. In other embodiments, the hinge can be above the interface of the base of the ring and pinky fingers and the top of the palm. The hinge may be made from any durable, flexible material such as leather or other natural or synthetic material.

Strap

On the other end of hinge 105, elastic tensioner 109 is connected to strap 104. Strap 104 works cooperatively with hinge 105 and elastic tensioner 109 to retain a golf club when strap 104 is coupled to strap receiver 106. Finally, strap 104 also includes a coupling portion top end 108. Coupling portion top end 108 is on the opposite side of coupling portion bottom end 102.

Coupling portion top end 108 is constructed from a stiffer material than the rest of strap 104. The stiffer material may be of natural materials, such as leather, or made of synthetic materials. The stiffer material of coupling portion top end 108 allows a user to easily grip and pull on strap 104, either to engage, tighten, or release strap 104 in relation to strap receiver 106.

In this embodiment, strap 104 measures approximately four inches in length and two inches wide. Strap 104 may be constructed from leather or a leather-like material on the coupling portion top end or a combination of leather and leather-like materials. The attached portion of strap 104 is comprised of elastic material on the bottom or the attached portion of strap 104.

Further, in this embodiment, strap 104 extends approximately four inches at the hinge up from the base of the fingers of the golf glove with a hook and loop material stitched into coupling portion bottom end 102 of the free portion of the strap where the hook and loop material couples to the material of the strap receiver. In other embodiments, the strap may be of slightly different length to accommodate the size of the hand of a wearer. Strap 104 is made from durable, stretchable, elastic material that can easily accommodate a range of golf club handle sizes.

Strap Receiver

Strap receiver 106 is located on the palm portion of golf glove 100 proximate the thumb on the thumb muscles of a palm. Coupling portion bottom end 102 and strap receiver 106 are made of materials that allow for easy coupling and releasing, such as hook and pile material. In order for strap 104 to couple to strap receiver 106, strap 104 further includes a coupling portion bottom end 102.

Coupling portion bottom end 102 is located on the underside of strap 104. In use, golf club retainer 110 holds a golf club in place when coupling portion 102 of strap 104 is mated to strap receiver 106.

The gripping torque on the golf club can be adjusted to each individual golfer depending on the alignment and positioning desired by each individual golfer by simply adjusting fastening strap 104 higher or lower on the pad of strap receiver 106. Any adjustment made for individual preferences will still maintain a tension-free grip required for improving the wearer's ball striking technique.

Finger Tension Guide

Next, finger tension guide 107 will be described. Finger tension guide 107 is located from the distal transverse palmer crease, along the transverse palmer crease up to and including the ring and pinky finger of golf glove 100, further extending around the back of the glove. Finger tension guide 107 extend from the base of the ring and pinky finger region of golf glove 100 and wraps around the ring and pinky finger portions of golf glove 100, further extending around the dorsal side of the hand. In other words, the ring finger and the pinky finger portion of finger guide 107 include a base proximate the palm transverse palmer crease and the top end distal the palm, where finger tension guide 107 extends from the base of the ring and pinky finger toward the direction of the tips of the ring and pinky fingers, further extending around the fingers to incorporate a portion of the dorsal side of the hand.

In this example of finger tension guide 107, the ring finger and the pinky finger include a base proximate the palm transverse palmer crease and a top end distal the palm, where the ring finger and the pinky finger portions of finger tension guide 107 extend past the wearer's first phalanges and terminates adjacent to the wearer's middle phalanges. In other embodiments, the finger tension guide may extend into the corresponding middle phalanges of the golf glove. Finger tension guide 107 is composed of a resilient, stretchable, and flexible material such as natural leather or other similar man-made material that provide the required stretch and support to the wearer's index and pinky finger when gripping and swinging a golf club.

Grip Positioning Insert

Grip positioning insert 101 is located between the palmar digital and the proximal palmar region of the human palm and correspondingly on golf glove 100. Grip positioning insert 101 is fixedly attached to golf glove 100 where the gloved palm portion between the palmer digital and the proximal palmer regions that correspond to the hand of the wearer. Grip positioning insert 101 extends toward the base of the ring finger and the pinky finger region, further extending laterally from a position proximate to the interface of the glove palm portion of the leading hand adjacent to the pinky finger extending toward and proximate to the proximal phalanges of the index finger.

Grip positioning insert 101 is designed to serve two primary purposes. One purpose of grip positioning insert 101 is to provide a directional gripping channel to position the golf club correctly in the leading hand of the golfer. A second purpose, when working in conjunction with finger tension guide 107 is to enhance the gripping mechanism of strap 104 that is fixedly attached or coupled to the bottom of grip positioning insert 101 at the base of the finger region.

As the hand of the wearer and strap 104 is wrapped around a club handle 108, strap 104 is operatively stretched and attached to strap receiver 106 located in the area of the golf glove corresponding to top of the thumb muscle. In this manner, the grip is secured in the correct position with respect to the palm and fingers of the leading hand.

In the example shown in the Figures, grip positioning insert 101 measures approximately two to two and a half inches wide and two to two and a half inches in length depending on the size of the glove. Grip positioning insert 101 is positioned at approximately a 30 degree angle on the left palm of the gloved hand when the leading hand of the golfer is his left hand. In addition to these dimensions, other sizes and dimensions are contemplated herein and it should be evident to one of ordinary skill in the art that different sizes and shaped gloves may require different sized positioning inserts.

In this embodiment, the bottom palm portion of grip positioning insert 101 extends from just under the palm pad down to the base of the fingers. Grip positioning insert 101 encompasses up to the last knuckle joints of the first and second fingers of the leading hand. The bottom portion of grip positioning insert 101 extending laterally from the edge of the palm adjacent to the base of the pinky finger toward the base proximal phalanges of the index finger.

Grip Positioning Guide

Grip positioning guide 103 is incorporated in the grip positioning insert 101 and includes an array of directional ridges that run along the proximal palmer seam of the hand of the wearer at approximately thirty degrees. Grip positioning guide 103 extends from under the interior border of the thenar region toward the proximal interphalangeal joint of the index finger. The plurality of at least three gripping and directional ridges create channels to aid the wearer in positioning and gripping the golf club within the hand.

In some embodiments, the ridges measure approximately 3, 2.5, and 2 inches long by ⅛ inches wide by 1/32 high respectively beginning at the top portion of the insert just under the palm muscle extending down to the base of the fingers. In this example, the ridges are spaced approximately ⅛ inches between each other to allow for a small degree of club placement options, however, other sizes, spacing, and dimensions are contemplated herein.

In this embodiment, the leather covered ridges of grip positioning guide 103 are filled with a synthetic rubber material that provides some flexible gripping characteristics to the insert and allows the golf club to be slightly adjusted in the palm and fingers of the leading hand to allow a more neutral or stronger grip position depending on the wearer's preference. In other words, the grip design allows the wearer to simply place the golf club handle into the natural channel formed by grip positioning guide 103 on the palm of the leading hand at approximately a 30 degree angle across the palm toward the part of the palm where the palm meets the base of the fingers, and the first knuckle of the index finger. In other embodiments, the grip positioning guide is filled with other cushioning material such as foam or cotton.

Grip positioning guide 103 automatically positions the wearer's hand correctly on the golf club handle, where the handle is securely positioned between the palm pad and the base of the last two fingers, the ring and pinky fingers, extending to the trigger finger or the second knuckle of the index finger, when the hand is closed. In use, the wearer simply closes the leading hand around the club handle, pulls the end of elastic fastening strap 104 from the base of the ring and pinky fingers and secures coupling portion 102.

The torque and gripping action of the disclosed technology is created by the "wrapping" and stretching of the elastic portion of strap 104 which originates from the base of grip positioning insert 101 and grip positioning guide 103 around the golf club handle 108 up to strap receiver 106 at the top and outer edge of the thumb muscle (adjacent to the base of the thumb) and wrist. The combination of the stretching and resulting torque pulls the golf handle into the palm pad of the leading hand and also gently pulls the bottom two fingers, the ring and pinky fingers of the leading hand, against the golf handle in the correct position, creating a soft, tension-free secure grip.

Grip positioning guide 103 also keeps the wearer's grip properly positioned in the palm and base of the fingers to allow for maximum wrist hinging and release, which is a major factor in developing maximum club head speed for improving distance and control.

In addition to the features that the present invention provides for improving ball striking on the tee, fairway and short game, the grip is also designed to provide a secure and tension-free grip while putting. For the putter grip, the golfer simply places the club handle in the natural channels of grip positioning guide 103 of the leading hand palm so the putter face is square to the putting line, fastens strap 104 to strap receiver 106 on the thumb pad, positions the other hand on the club, and the wearer is ready to strike the ball. It should be noted that most missed putts are caused by hitting putts "offline" which occurs when the putter face is moved from a square position. The current invention keeps the putter face square to the putting line, significantly reducing offline putts and improving ball striking.

Ventilation Holes

Golf game improvement glove 100 further includes ventilation holes 111. Ventilation holes 111 are disposed on the body of golf glove 100 to allow for greater air flow and thus cooling the hand of the wearer for more comfortable play. In the current embodiment, ventilation holes 111 are located on golf glove 100 in positions corresponding to the finger portion on the hand of the wearer. In other embodiments, the ventilation holes may be in any pattern throughout the golf glove, and may incorporate the use of a ventilated stretchy, elastic material.

Wrist Securing Mechanism

Figure 2:
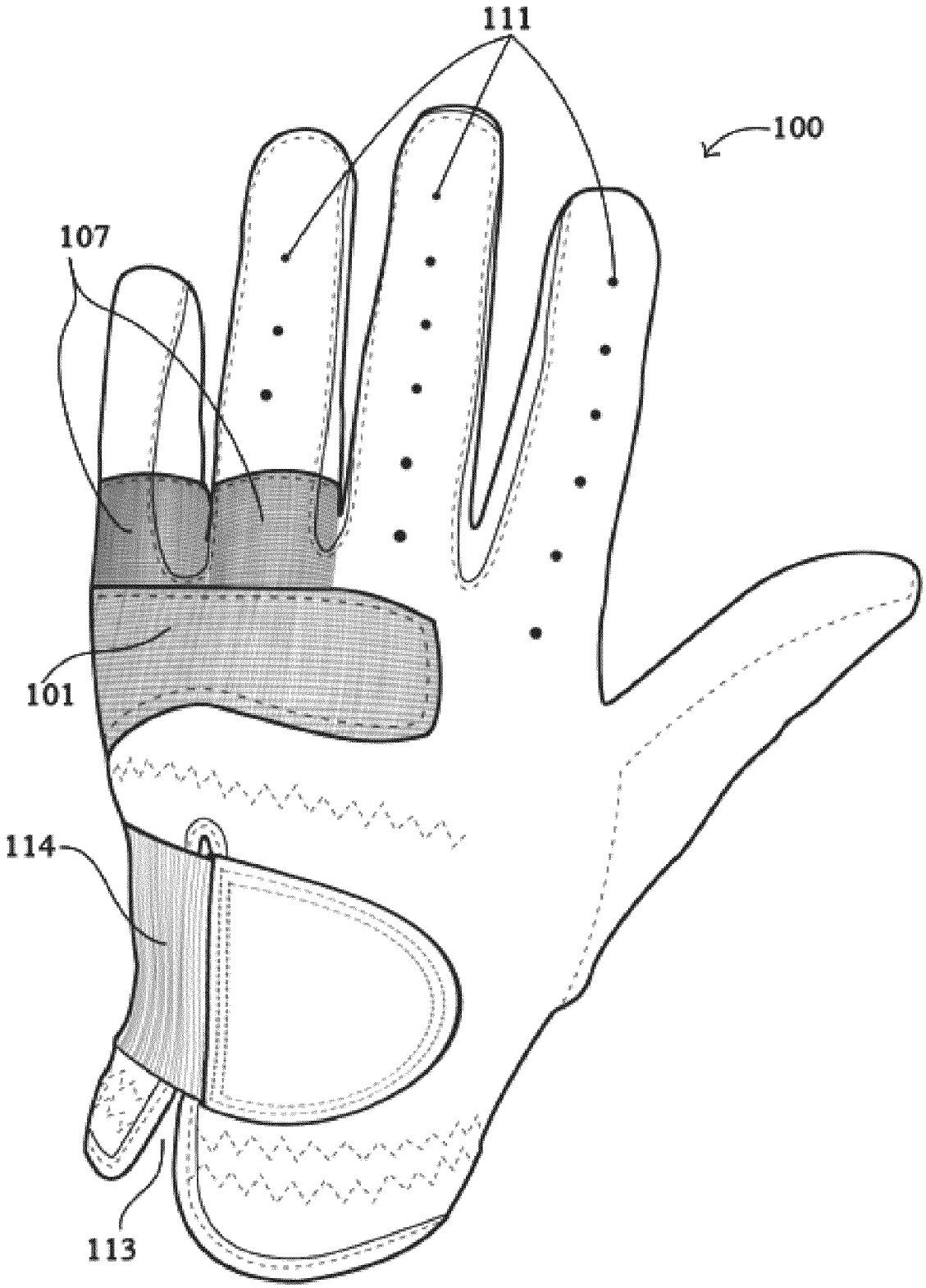
FIG. 2 is an open back-of-the-hand view of the golf glove shown in FIG. 1 illustrating the position of the finger tension guide that encircles the ring and the pinky fingers. The grip positioning insert attached to the volar region of the palm extending to the end of the palm adjacent to and below the pinky finger, further wrapping around the side of the golf glove and attaching to the dorsal side of the golf glove.
Figure 3:
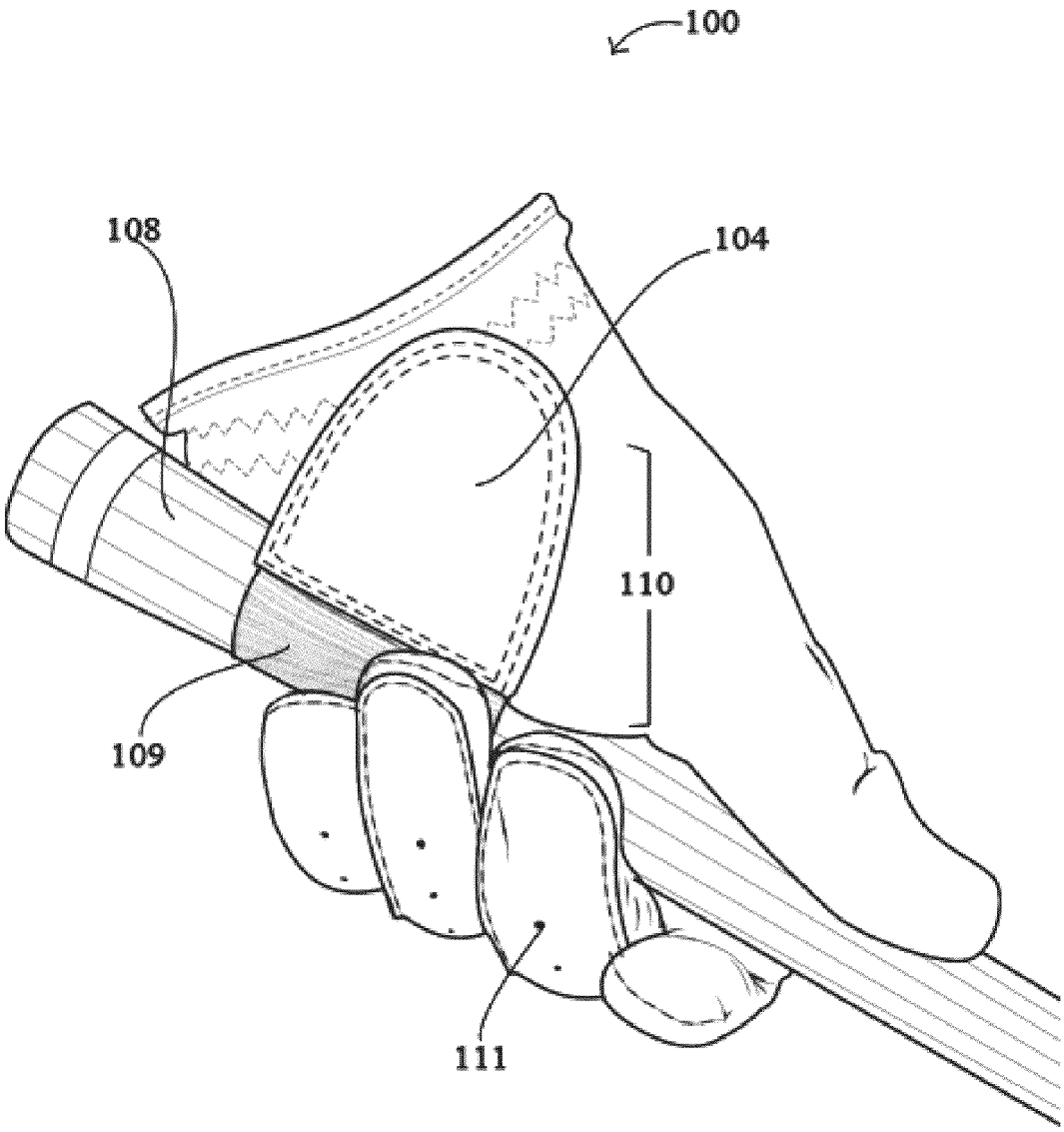
FIG. 3 is a front view showing the golf glove shown in FIG. 1 when worn in a closed hand position where the hand grips a golf club retained within the fastening strap and the strap receiver.
Figure 4:
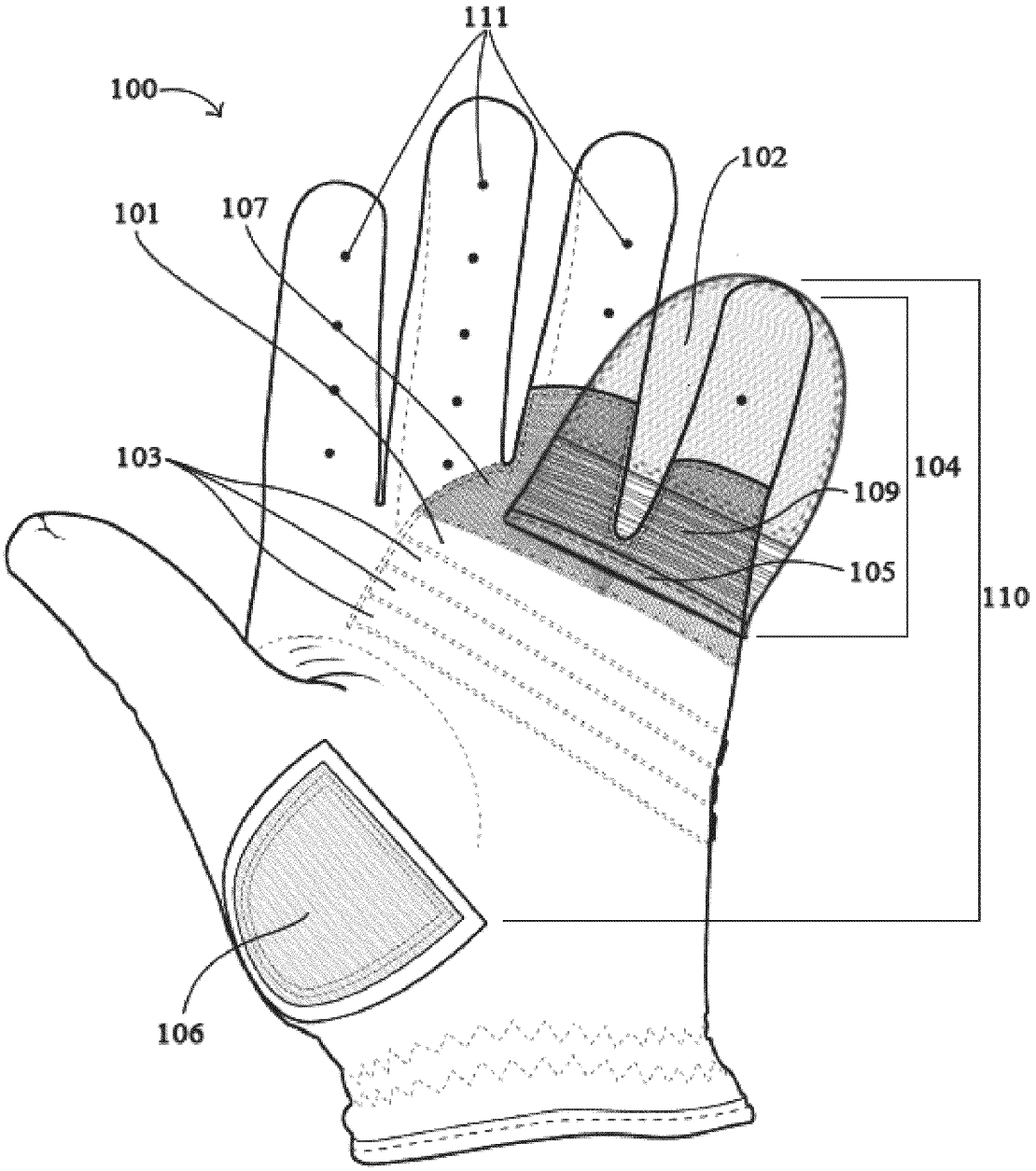
FIG. 4 is an open palm view of the golf glove shown in FIG. 1 where the fastener strap is lifted up and the underside of the fastener strap is shown and illustrating the position of the grip positioning guide and function of the golf club retainer.

In order to have a glove that fits snuggly on the wearer's hand, but also allows for easy putting on and taking off, in the present embodiments of the golf glove includes a notch 113 located at the base of the golf glove as shown in FIG. 2. Notch 113 runs essentially parallel to the long axis of the hand and allows the widest portion of a wearer's hand to fit through the golf glove while still allowing for a snug fit of golf glove 100 on the wearer's hand.

Also included in golf glove 100 is wrist securing mechanism 114. Wrist securing mechanism 114 secures golf glove 100 to the hand of the wearer. In this embodiment, wrist securing mechanism 114 includes a securing strap that originates on one side of the notch and extends over notch 113 to the opposite side of notch where it is secured thereby providing a snugger fit. In other embodiments, the securing mechanism may be an elastic portion that stretches and tightens at the base of the glove located adjacent to the wearer's wrist, providing for a more secure-fitting glove.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A glove for assisting a user to correctly grip a golf club with a user's leading hand, the glove comprising:

a palm;

a back coupled to the palm;

fingers coupled to the palm and the back, the fingers including:

an index finger configured to receive a user's index finger;

a middle finger configured to receive a user's middle finger;

a ring finger configured to receive a user's ring finger;

a pinky finger adjacent to the ring finger and configured to receive a user's pinky finger; and a thumb opposite the pinky finger and configured to receive a user's thumb; and a club retainer coupled to the palm, the back, and the fingers of the leading hand, the club retainer including:

a hinge comprising a hinge first end and a hinge second end;

the hinge first end coupled to the glove at the interface between the palm and the ring finger and the pinky finger where the hinge is constructed with elastic stretch material;

a fastening strap connected to the hinge second end; and a strap receiver located on the palm proximate the thumb and configured to operatively couple with the fastening strap;

wherein the club retainer is configured to support and align the golf club handle between the palm and the fastening strap when the fastening strap is operatively coupled to the strap receiver, providing a reduced-tension grip.

2. The glove of claim 1, further comprising a finger tension guide coupled to and disposed from the transverse palmer crease around the ring finger and the pinky finger, further extending around a portion of the dorsal side of the leading hand, wherein the hinge is fixedly attached to the finger tension guide.

3. The glove of claim 1, wherein the glove is comprised of a resilient and flexible material, including natural leather or man-made materials.

4. The glove of claim 2, wherein:

the ring finger and the pinky finger portions of the finger tension guide each include a base proximate the palm and distal the palmer digital area; and the finger tension guide extends from the distal transverse palmer line past the base of the ring finger and the base of the pinky finger portions towards and proximate to the middle proximal phalanges of the ring and pinky fingers of the glove, around to the dorsal side of the gloved hand.

5. The glove of claim 4, wherein:

the ring finger and the pinky finger portions each include a proximal phalanges region proximate the palm and overlying the proximal phalanges portion of the corresponding human fingers;

the finger tension guide extending into the proximal phalanges region of the pinky finger and the ring finger around to the dorsal side of the gloved hand.

6. The glove of claim 2, wherein the finger tension guide is comprised of natural leather or a synthetic, flexible, stretchable, and supportive material.

7. The glove of claim 1, further comprising a grip positioning insert fixedly attached to an area of the gloved palm portion between the palmar digital and the proximal palmer regions of the human palm, wherein the grip positioning insert extends past the base of the ring finger and the pinky finger, to the interface of the glove palm portion and adjacent to the pinky finger of the glove, further extending laterally toward the proximal phalanges of the index finger.

8. The glove of claim 1, further comprising a grip positioning guide, disposed and incorporated to the grip positioning insert and comprising directional ridges that run along the proximal palmer seam of the human hand from under the interior border of the thenar to the proximal interphalangeal joint of the index finger to provide channels to receive the golf club handle in a desired position relative to the leading hand.

9. The glove of claim 8, wherein the directional ridges stitched and enclose a cushioning material.

10. The glove of claim 9, wherein the directional ridges are at approximately thirty degree angle from the between the thumb and index finger portion of the glove to the outer edge of the glove.

11. The glove of claim 9, wherein the cushioning material is a silicone elastomeric material.

12. The glove of claim 1, wherein the hinge at the interface between the gloved palm portion and the ring finger and the pinky finger glove portion comprises a flexible material which allows for easy adjustment of the fastening strap.

13. The glove of claim 7, wherein the hinge at the interface between the gloved palm portion and the ring finger and the pinky finger glove portion is natural leather or a leather-like material.

14. The glove of claim 1, wherein the stretchable connector is an elastic material.

15. The glove of claim 1, wherein the fastening strap further comprises a top surface and a bottom surface, wherein the top surface comprises a sturdy yet flexible material, and the bottom surface comprises a hook or pile material configured to mate the fastening strap to the strap receiver.

16. The glove of claim 1, wherein the strap receiver is the corresponding hook or pile material that couples the strap receiver to the fastening strap.

17. The glove of claim 1, further comprising apertures for venting, formed on underside portions of the fingers of the glove or located on the palm portion of the glove.

18. The glove of claim 1, wherein the bottom end includes a notch that allows for easier access of the widest portion of the user's hand through the bottom end of the glove.

19. The glove of claim 1, further comprising a means for securing the glove at the hand-wrist interface of the glove when worn.

20. The glove of claim 19, wherein the means for securing the glove to the user's hand includes a security strap stitched to the portion of the glove on one side of the notch with a hook and pile type closure at its free end, and a corresponding hook or pile receiver to secure the security strap.

* * * * *